US012484646B2

(12) United States Patent
Lonati et al.

(10) Patent No.: US 12,484,646 B2
(45) Date of Patent: Dec. 2, 2025

(54) PROCESS FOR MAKING A GARMENT

(71) Applicant: SANTONI S.P.A., Brescia (IT)

(72) Inventors: Andrea Lonati, Brescia (IT); Lionello Spada, Brescia (IT)

(73) Assignee: SANTONI S.P.A., Brescia (IT)

( * ) Notice: Subject to any disclaimer, the term of this patent is extended or adjusted under 35 U.S.C. 154(b) by 194 days.

(21) Appl. No.: 17/914,084

(22) PCT Filed: Mar. 23, 2021

(86) PCT No.: PCT/IB2021/052386
§ 371 (c)(1),
(2) Date: Sep. 23, 2022

(87) PCT Pub. No.: WO2021/191785
PCT Pub. Date: Sep. 30, 2021

(65) Prior Publication Data

US 2023/0124736 A1 Apr. 20, 2023

(30) Foreign Application Priority Data

Mar. 27, 2020 (IT) ..... 102020000006514

(51) Int. Cl.
*A41D 27/10* (2006.01)
*A41D 1/04* (2006.01)
(Continued)

(52) U.S. Cl.
CPC ..... *A41D 27/10* (2013.01); *A41D 1/04* (2013.01); *A41D 27/24* (2013.01); *A41H 3/08* (2013.01);
(Continued)

(58) Field of Classification Search
None
See application file for complete search history.

(56) References Cited

U.S. PATENT DOCUMENTS 2,126,186 A * 8/1938 Friedland ..... A41D 1/04 2/113
2,588,606 A * 3/1952 Artzt ..... A41D 1/04 2/113
(Continued)

FOREIGN PATENT DOCUMENTS

CN 101653295 A 2/2010
JP 2004091971 A 3/2004
WO 2020008333 A1 1/2020

OTHER PUBLICATIONS

English machine translation of CN 101 653 295 A. Via Clarivate Analytics performed on PE2E Search. Translation performed on May 21, 2024. (Year: 2010).*
(Continued)

*Primary Examiner* — Jameson D Collier
(74) *Attorney, Agent, or Firm* — MH2 TECHNOLOGY LAW GROUP LLP

(57) ABSTRACT

A process for making a garment, provided at least with a trunk (T), a right sleeve (MD) and a left sleeve (MS), includes the steps of: producing a tubular textile article (3), by means of a textile machine, having a shape with cylindrical surface extended around a central axis (X) between an upper edge (4) and a lower edge (5), wherein on the tubular textile article a front side (6) and a rear side (7) are definable, divided from each other with respect to a median plane (A); defining or identifying the textile article a plurality of cutting lines; cutting the textile article along the plurality of cutting lines so as to define and separate a plurality of fabric portions from one another; joining the fabric portions so as to obtain the trunk (T) of the garment, the right sleeve (MD) and the left sleeve (MS). Following the joining step, the garment (1) obtained from the tubular textile article exhibits zones of passage between the trunk (T) and the right (MD) and left (MS) sleeves lacking seams or discontinuities in the
(Continued)

fabric, i.e. the passage from the fabric of the trunk to the fabric of the right and left sleeves occurs without interruptions.

18 Claims, 5 Drawing Sheets

(51) Int. Cl.
*A41D 27/24* (2006.01)
*A41H 3/08* (2006.01)
*D04B 1/24* (2006.01)

(52) U.S. Cl.
CPC ..... *D04B 1/246* (2013.01); *A41D 2500/10* (2013.01)

(56) References Cited

U.S. PATENT DOCUMENTS 4,939,844 A * 7/1990 Fujimura ..... A41H 3/00 33/12
6,330,814 B1 * 12/2001 Fujiwara ..... D04B 1/246 66/8
6,353,934 B1 * 3/2002 Tada ..... A41D 27/10 2/87
6,389,850 B1 * 5/2002 Fujiwara ..... D04B 21/207 66/171
6,401,498 B1 * 6/2002 Fujiwara ..... D04B 21/207 2/243.1
10,925,338 B2 * 2/2021 Turner ..... D04B 1/246
2009/0064721 A1 3/2009 Shirasaki et al.
2015/0284885 A1 * 10/2015 Turner ..... D04B 21/207 28/142
2016/0366948 A1 * 12/2016 Diaz ..... A41D 27/06

OTHER PUBLICATIONS

Search Report dated Jun. 14, 2021 in corresponding International Application No. PCT/IB2021/052386, 3 pages.
Written Opinion dated Jun. 14, 2021 in corresponding International Application No. PCT/IB2021/052386, 7 pages.

* cited by examiner

PROCESS FOR MAKING A GARMENT

CROSS-REFERENCE TO RELATED APPLICATIONS

This application is a U.S. National Stage application of PCT/IB2021/052386 filed Mar. 23, 2021, pending, which claims priority to Italian Patent Application No. 102020000006514 filed Mar. 27, 2020, the entire disclosures of which are hereby incorporated by reference in their entireties.

FIELD OF THE INVENTION

The present invention relates to a process for making a garment, in particular, a sweater, from a tubular textile article. This garment is provided at least with a trunk and two sleeves and is designed to be worn on a person's torso. The tubular textile article used in the process of the present invention is preferably made with a circular knitting machine, in particular for knitted or hosiery items. The invention further relates to a garment obtained with this process.

BACKGROUND OF THE INVENTION

The present invention falls into the technical field of making and manufacturing garments, in particular sweaters, shirts, T-shirts and in general garments designed to be worn onto one's torso.

In addition, the present invention falls into the technical field of circular textile machines for knitted items, seamless knitted items, hosiery items and the like.

It is known to use circular textile machine, also seamless textile machines, for manufacturing tubular textile articles for making garments.

A typical example of a process for making a sweater or T-shirt, i.e. a garment provided with a trunk, two sleeves and an opening for one's neck, by means of tubular textile items (i.e. made with circular, and not linear, textile machines) usually includes making at least three distinct tubular elements: a first tubular element makes up the body of the sweater, i.e. is designed to cover the user's torso, whereas a third and a fourth tubular element make up the two sleeves of the sweater. In addition, further elements such as a collar, pockets, etc. can be added.

The two tubular elements making up the sleeves can also be obtained from one longer tubular element, which is then divided into the two elements.

Typically, the diameter of the needle-holding cylinder of the circular textile machines determines the sweater size, since the diameter of the tubular article that can be obtained, and thus the size of the sweater trunk, are related to it.

It is further known, when making the tubular elements, to design on them suitable cutting lines, whose aim it to prepare the various elements for the following sewing and manufacturing steps. As a matter of fact, one the three distinct tubular elements are manufactured, a series of seams have to be made in order to join the two sleeves to the trunk and finally assemble the sweater. In particular, once the sweater is manufactured, there is a complete seam around the shoulder and the armpit for each sleeve, whose aim is exactly to join the sleeve to the trunk on the so-called armhole. Two seams are also typically made on the shoulders, since the upper opening of the tubular element making up the trunk would be too large for the neck and would not cover the shoulders, therefore on the sides of the neck the fabric has to be sewn in order to reduce the opening and cover the shoulders.

SUMMARY

The Applicant has found that known processes for making garments and sweaters are not without drawbacks and can be improved under various aspects.

First of all, known processes exhibit limitations and disadvantages related to the long time required for producing and manufacturing a single sweater. This is due to the need to make the various tubular elements, prepare and sew them to one another, and to the complexity of these operations. These operations further require the intervention of skilled staff.

Globally, this leads to high costs related to the manufacture of each garment.

Moreover, known processes typically generate a large amount of processing scraps, i.e. fabric portions that are made but then are not used for manufacturing the garment.

A further drawback of known processes is the small volume of garments that can be made pro time unit, due to the long time required for making the various fabric portions and to the complexity of manufacturing operations.

More to the point, it is exactly the complexity of known processes that can lead to errors, especially during manufacturing, and cause inaccuracies in the finished article.

A further drawback of known processes is also the difficulty of obtaining products with uniform features and quality, due to the complexity of manufacturing operations.

In addition, a very important drawback of known processes and garments is the presence in the finished article of a group of seams that may be troublesome to the user, especially in some areas that are more delicate.

These seams reduce the comfort and wearability of the garment, and this is particularly important for underwear articles or sports shirts (i.e. sports shirts made of technical fabric), which adhere to the user's skin. In these cases seams, especially in some areas of the garment, can cause irritations or anyhow reduce the comfort of the garment during use, especially long use.

Under these circumstances, the Applicant has found out that known processes and garments do not offer required performance as far as both garment production and the use by the final user wearing these garments are concerned.

Under these circumstances, the aim underlying the present invention in its various aspects and/or embodiments is to provide a process for making a garment and a garment obtained by means of this process, which can obviate one or more of the drawbacks referred to above.

A further aim of the present invention is to provide a process for making a garment, characterized by a reduced complexity of operations and by lower costs than known solutions.

A further aim of the present invention is to provide a process for making a garment, which allows to reduce the time needed for producing a garment with respect to known solutions.

A further aim of the present invention is to provide a process for making a garment, which can be automated and implemented by means of an automated manufacturing line.

A further aim of the present invention is to provide a process for making a garment, which allows to reduce processing scraps.

A further aim of the present invention is to provide a process for making a garment, characterized by lower costs for the finished article than known solutions.

A further aim of the present invention is to provide a process for making a garment, which allows to reduce errors during production and manufacturing, in order to obtain garments without inaccuracies.

A further aim of the present invention is to provide a process for making a garment, which allows to obtain products with high quality and uniform features.

A further aim of the present invention is to provide a process for making a garment, which allows to obtain garments characterized by a better wearability and comfort for the user, in particular for garments such as underwear and sports shirts or sweaters.

Another aim of the present invention is to propose a process that enables to make garments, and in particular sweaters, with specific aesthetic features.

Another aim of the present invention is to propose a process that enables to make garments, and in particular sweaters, in an economically competitive manner.

A further aim of the present invention is to create alternative solutions to the prior art for designing, making and manufacturing garments, in particular of the type provided with a trunk and two sleeves, and/or to open new design possibilities.

These and other possible aims, which shall appear better from the following description, are basically achieved by a process for making a garment, and by a garment obtained by this process, according to one or more of the appended claims, each one being considered alone (without those depending on it) or in any combination with the other claims, and according to the following aspects and/or embodiments, variously combined, also with the aforesaid claims.

In a first aspect thereof, the invention relates to a process for making a garment, said garment being in particular a sweater or similar garment provided with at least one trunk, a right sleeve and a left sleeve.

In one aspect, the process comprises the following steps:

- arranging a textile machine, preferably a circular textile machine;
- producing a tubular textile article by means of said textile machine, so that the tubular textile article has a shape substantially with cylindrical surface extended continuously around a central axis of the article between an upper edge and a lower edge.

In one aspect, on said tubular textile article a front side and a rear side are definable, divided from each other with respect to a median plane.

In one aspect, the median plane vertically divides the tubular textile article substantially in two halves, corresponding to said front and rear side.

In one aspect, the process comprises the step of defining or identifying a plurality of cutting lines on said tubular textile article.

In one aspect, the process comprises the step of cutting the tubular textile article along said plurality of cutting lines so as to define and separate from one another a plurality of fabric portions of the tubular textile article, each fabric portion belonging to said front side, or to said rear side, or partially to the front side and partially to the rear side.

In one aspect, said fabric portions are divided from one another, by means of the cutting lines, though at least partially joined (i.e. connected) in the tubular textile article (which remains as one piece).

In one aspect, the process comprises the step of joining said fabric portions of the tubular textile article in order to obtain the trunk of the garment, the right sleeve and the left sleeve.

In one aspect, following said joining step, the garment obtained from the tubular article exhibits zones of passage between the trunk and the right and left sleeves lacking seams or discontinuities in the fabric, i.e. the passage from the fabric of the trunk to the fabric of the right and left sleeves occurs at least partially without interruptions (i.e. seamlessly).

In one aspect, the aforesaid zones of passage between the trunk and the right and left sleeves are the zones of the garment located, both on the front and on the rear side, between the shoulders and the armpits.

In one aspect, the garment does not exhibits seams, discontinuities or joints, either on the right armhole or on the left armhole. In one aspect, both on the front and on the back of the garment there is a direct (continuous) passage of the fabric from the trunk to the sleeves, without the presence of right or left armhole.

In one aspect, the garment is without right and left armholes.

In one aspect, said fabric portions comprise at least:

- a front trunk portion, belonging to the front side of the tubular textile article;
- a rear trunk portion, belonging to the rear side of the tubular textile article;
- a right sleeve portion, comprising fabric both of the front side and of the rear side, and intersecting said median plane;
- a left sleeve portion, comprising fabric both of the front side and of the rear side, and intersecting said median plane on the opposite side of said central axis with respect to the right sleeve portion.

In one aspect, said step of joining said fabric portions comprises:

- joining said front trunk portion to said rear trunk portion in order to make the trunk of the garment, said trunk having at least partially tubular shape;
- closing said right sleeve portion for making a right sleeve, said right sleeve having at least partially tubular shape;
- closing said left sleeve portion for making a left sleeve, said left sleeve having at least partially tubular shape.

In one aspect, said front trunk portion and said rear trunk portion are separated from one another by said left sleeve portion and said right sleeve portion.

In one aspect, said step of cutting the tubular textile article creates, by following a circumferential extension of the tubular textile article around the central axis, an alternation between a trunk portion and a sleeve portion.

In one aspect, said step of cutting the tubular textile article creates, by following a circumferential extension of the tubular textile article around the central axis, the following alternation of portions: front trunk portion, right sleeve portion, rear trunk portion, left sleeve portion.

In one aspect, said median plane of the tubular textile article passes through said central axis or is parallel thereto.

In one aspect, said front side and said rear side develop continuously one after the other, thus forming said cylindrical surface of the tubular textile article.

In one aspect, the lower edge and the upper edge have a substantially circumferential shape.

In one aspect, in said step of producing a tubular textile article a single tubular textile article is produced, which allows to make trunk and sleeves of the garment as one piece.

In one aspect, the trunk, the right sleeve and the left sleeve are globally at least partially joined and continuous one after the other in a one-piece fabric.

In one aspect, said trunk, said right sleeve and said left sleeve, belonging to the same tubular textile article, are never detached or separate from one another, said garment being made as one piece starting from the tubular textile article.

In one aspect, said fabric portions, as a result of said step of cutting the tubular textile article, are not divided or separated completely from one another, but remain at least partially joined within the one-piece tubular textile article.

In one aspect, the front side is always at least partially connected in a continuous manner to the rear side of the tubular article, also as a result of the cuts made along said cutting lines. In particular, the front side and the rear side remain connected in the high part of the torso and in the areas around the shoulders of the garment.

In one aspect, from the step of producing the tubular textile article to the end of the step of making or manufacturing the garment, there is never a step of longitudinally cutting the tubular textile article from the lower edge to the upper edge (or vice versa) or a step of opening the tubular textile article obtaining a flat (and not a cylindrical) piece of fabric.

In one aspect, in said step of producing a tubular textile article, said tubular textile article is a single layer fabric.

In one aspect, in said step of producing a tubular textile article, said tubular textile article is a double layer fabric.

In one aspect, said step of defining or identifying, on said tubular textile article, a plurality of cutting lines comprises one or more of the following operations:

- designing on the tubular textile article, in construction step, said cutting lines, for example by means of threads of a different color with respect to the adjacent portions of the tubular textile article;
- showing or projecting on the tubular textile article, before and/or during said step of cutting the tubular textile article, said cutting lines, for example by means of an optical light or laser device capable of defining and rendering the cutting lines visible;
- programming a machine for automated cutting, defining at its interior, for example in a control software for such machine, the cutting lines such that it can operate on the tubular textile article and automatically make said cutting lines;
- tracing on the tubular textile article, before and/or during said step of cutting the tubular textile article, said cutting lines.

In one aspect, said step of defining or identifying a plurality of cutting lines on said tubular textile article can be carried out directly during the step of cutting the tubular textile article, e.g. manually by an operator.

In one aspect, said cutting lines all start from said lower edge of the tubular textile article and develop towards said upper edge.

In one aspect, said cutting lines developing from said lower edge end into the tubular textile article before reaching the upper edge, i.e. they do not end or lead onto the upper edge.

In one aspect, said cutting lines are interrupted in an intermediate portion of the tubular textile article between the lower edge and the upper edge.

In one aspect, in said step of cutting the tubular textile article, said cutting lines do not (never) cause said tubular article to be opened, i.e. the textile article maintains at least one continuous tubular fabric portion which is closed all around the central axis. In other words, said cutting lines are never such as to make the textile article a sheet fabric, i.e. no longer tubular.

In one aspect, none of said cutting lines develops between, or joins, said lower edge and said upper edge.

In one aspect, said cutting lines develop longitudinally from said lower edge of the tubular textile article following a direction that substantially corresponds to the longitudinal development of the tubular textile article from the lower edge to the upper edge, i.e. corresponding or parallel to the central axis of the tubular textile article.

In one aspect, said step of joining said fabric portions occurs by means of seams, or the like, made between the fabric portions to be joined.

In one aspect, each of said cutting lines creates two fabric margins belonging to two adjacent fabric portions, the two margins being at the sides of the cutting line.

In one aspect, said plurality of cutting lines comprises at least one first cutting line, one second cutting line, one third cutting line and one fourth cutting line, wherein:

- the first cutting line is positioned on the front side of the tubular textile article and separates the front trunk portion and the right sleeve portion from each other, thus creating a right margin of the front trunk portion and a front margin of the right sleeve portion (both margins being on the front side);
- the second cutting line is positioned on the front side of the tubular textile article and separates the front trunk portion and the left sleeve portion from each other, thus creating a left margin of the front trunk portion and a front margin of the left sleeve portion (both margins being on the front side);
- the third cutting line is positioned on the rear side of the tubular textile article and separates the rear trunk portion and the right sleeve portion from each other, thus creating a right margin of the rear trunk portion and a rear margin of the right sleeve portion (both margins being on the rear side);
- the fourth cutting line is positioned on the rear side of the tubular textile article and separates the rear trunk portion and the left sleeve portion from each other, thus creating a left margin of the rear trunk portion and a rear margin of the left sleeve portion (both margins being on the rear side).

In one aspect, following the step of cutting the tubular textile article along said first, second, third and fourth cutting lines:

- the front trunk portion is laterally extended between its right margin and its left margin and is entirely on the front side;
- the rear trunk portion is laterally extended between its right margin and its left margin and is entirely on the rear side;
- the right sleeve portion is laterally extended between its front margin and its rear margin and is thus shared between the front side and the rear side;
- the left sleeve portion is laterally extended between its front margin and its rear margin and is thus shared between the front side and the rear side.

In one aspect, each of said first, second, third and fourth cutting lines has a linear development, possibly with curves, from its beginning on the lower edge to its end point in the respective side of the tubular textile article.

In one alternative aspect, one or more of said first, second, third and fourth cutting lines can be shaped as an elongated upside down "V", wherein said "V" is obtained starting from the lower edge of the tubular article, up towards said upper edge as far as a given point and then down until ending again onto the lower edge, in a point at a lateral distance from the starting point, so as to create a "V"-shaped fabric piece corresponding to the shape defined by the cutting line.

In one aspect, one or more of the cutting lines can be variously shaped or undulated in order to obtain a specific three-dimensional shape of the trunk and of the sleeves in the finished garment.

In one aspect, in said step of joining said fabric portions of the tubular textile article:

- the right margin of the front trunk portion is joined with the respective right margin of the rear trunk portion, by means of a first junction line;
- the left margin of the front trunk portion is joined with the respective left margin of the rear trunk portion, by means of a second junction line;
- in such a manner, the first and the second junction line complete the connection of the front trunk portion with the rear trunk portion, thus making the trunk of the garment.

In one aspect, in said step of joining said fabric portions of the tubular textile article:

- the front margin of the right sleeve portion is joined with the rear margin of the same right sleeve portion, by means of a third junction line;
- the front margin of the left sleeve portion is joined with the rear margin of the same left sleeve portion, by means of a fourth junction line;
- in such a manner the third junction line closes and completes the right sleeve of the garment, and the fourth junction line closes and completes the left sleeve of the garment.

In one aspect, said first junction line, second junction line, third junction line and fourth junction line are seams made between the two involved fabric margins. As an alternative to sewing, each junction line can be obtained with analogous methods, e.g. as taping, gluing or welding.

In one possible embodiment, said first junction line and said third junction line are located in series to one another, in a continuous manner, so as to form a continuous (seamless) right junction line, i.e. an upper end of the first junction line coincides with an upper end of the third junction line, so that one can pass seamlessly from the first junction line to the third junction line (or vice versa). In one aspect, this point of passage from the first junction line to the third junction line is designed to be in a position corresponding, with the garment in use, to the user's right armhole.

In one aspect, the upper end of the first junction line and the upper end of the third junction line correspond to the respective terminal points both of the first cutting line and of the third cutting line.

In one aspect, the lower end of the first junction line connects the lower point of the right margin of the front trunk portion and the lower point of the right margin of the rear trunk portion, both these lower points being placed on the lower edge of the tubular textile article.

In one aspect, the lower end of the third junction line connects the lower point of the front margin of the right sleeve portion and the lower point of the rear margin of the right sleeve portion, both these lower points being placed on the lower edge of the tubular textile article.

In one aspect, said right junction line develops, preferably in a seamless manner, starting from the lower end of the first junction line, proceeds (up towards the upper edge of the tubular textile article) as far as said point of passage from the first junction line to the third junction line, then further proceeds (down towards the lower edge of the tubular textile article) as far as said lower end of the third junction line, where it ends.

In one possible embodiment, said second junction line and said fourth junction line are located in series to one another, in a continuous manner, so as to form a continuous (seamless) left junction line, i.e. an upper end of the second junction line coincides with an upper end of the fourth junction line, so that one can pass seamlessly from the second junction line to the fourth junction line (or vice versa). In one aspect, this point of passage from the second junction line to the fourth junction line is designed to be in a position corresponding, with the garment in use, to the user's left armhole.

In one aspect, the upper end of the second junction line and the upper beginning of the fourth junction line correspond to respective terminal points of the second cutting line and of the fourth cutting line.

In one aspect, the lower end of the second junction line connects the lower point of the left margin of the front trunk portion and the lower point of the left margin of the rear trunk portion, both these lower points being placed on the lower edge of the tubular textile article.

In one aspect, the lower end of the fourth junction line connects the lower point of the front margin of the left sleeve portion and the lower point of the rear margin of the left sleeve portion, both these lower points being placed on the lower edge of the tubular textile article.

In one aspect, said left junction line develops, preferably in a seamless manner, starting from the lower end of the second junction line, proceeds (up towards the upper edge of the tubular textile article) as far as said point of passage from the second junction line to the fourth junction line, then further proceeds (down towards the lower edge of the tubular textile article) as far as said lower end of the fourth junction line, where it ends.

In one possible embodiment, the process comprises the step of applying a right insert to the tubular textile article, in a position comprised between said first junction line and said third junction line, in a manner such that the right insert is interposed between, and connecting, said first junction line (in particular the upper end of the first junction line) and said third junction line (in particular the upper end of the third junction line), said right insert being intended to be, with garment in use, on the user's right armhole.

In one possible embodiment, the process comprises the step of applying a left insert to the tubular textile article, in a position comprised between said second junction line and said fourth junction line, in a manner such that the left insert is interposed between, and connecting, said second first junction line (in particular the upper end of the second junction line) and said fourth junction line (in particular the upper end of the fourth junction line), said left insert being intended to be, with garment in use, on the user's left armhole.

In one aspect, said right insert and said left insert are configured for eliminating discontinuities that can be present between the first and the third junction line and between the second and the fourth junction line, respectively.

In one aspect, said right insert and said left insert are configured for avoiding the presence of junction lines, e.g. seams, in the two zones of the garment intended to be, with the garment in use, on the user's armholes.

In one aspect, said right insert and said left insert are configured for suitably shaping the garment in the two zones of the garment itself intended to be with the garment in use, on the user's armholes.

In one aspect, said right insert and said left insert are obtained from the same tubular textile article on which the fabric portions forming the trunk, the right and left sleeves are defined, e.g. from waste portions obtained after the cutting step.

In one possible embodiment, said right insert and said left insert are made of breathable fabric.

In one possible embodiment, said right insert and said left insert are made of reinforcing fabric.

In one aspect, the process comprises the step of applying to the tubular textile article one or more inserts in specific positions along one or more junction lines.

In one aspect, each of said inserts is intended to be interposed along a specific junction line, locally interrupting, on the position where it is located, the continuity of such junction line.

In one aspect, if the junction line is a seam, such insert can locally interrupt or open the seam; in particular is interrupted at the beginning of the insert, proceeds on the sides of the itself and is resumed at the end of the insert.

In one aspect, said insert is configured for suitably shaping the garment in the zone of the garment itself where it is positioned, and/or for providing such zone with particular characteristics of elasticity or compression or breathability and/or specific aesthetic or technical characteristics.

In one aspect, the process includes a step of suitably sizing the trunk and the right and left sleeves in a manner such that the right and left sleeves are longer than the trunk of the garment.

In one aspect, the respective lower ends of the right sleeve and of the left sleeve have a lengthwise extension that terminates, once the garment is completed, lower than the lower end of the trunk.

In one aspect, the two sleeves proceed, in the lower part of the garment, as far as a point, at a distance from the top of the garment (with shoulders and neck), that is higher than the point reached by the end of the trunk (always referred to the top of the garment).

In one aspect, said sizing step is executed in said step of producing a tubular textile article, in a manner such that the parts of the tubular textile article intended, following the cuts, to form the right sleeve portion and the left sleeve portion are longer than the parts of the tubular textile article intended, following the cuts, to form the front trunk portion and the rear trunk portion.

In one aspect, said sizing step comprises a step of removing a lower section of the front trunk portion and a lower section of the rear trunk portion, in a manner such to shorten such portions with respect to the right sleeve and left sleeve portions, obtaining a trunk that is shorter than the sleeves. Preferably, the length reduction of the front trunk portion and the length reduction of the rear trunk portion are identical to one another; in this case, the two lower sections removed from the two trunk portions are substantially identical.

In one aspect, in said step of removing a lower section of the front trunk portion and a lower section of the rear trunk portion, the sections removed are horizontal strips cut starting from the lower edge of the tubular textile article. In this case, a result of the front trunk portion and of the rear trunk portion being reduced in length, the original lower edge of the textile article, as obtained from the step for producing the same, is left only on the lower ends of the right sleeve and of the left sleeve.

In one aspect, the process comprises a step of making a double hem on the lower edge of the trunk of the garment.

In one aspect, the process comprises a step of making respective double hems on the respective lower ends of each of the two right and left sleeves.

In one aspect, said step of making a double hem is performed simultaneously with the step of producing the tubular textile article, by making a double fabric, or cuff, on the lower edge of the tubular textile article. In one aspect, the tubular textile article is already produced with the entire lower edge made of double fabric for the entire circumferential extension thereof and, following the steps of cutting the tubular textile article and joining the fabric portions obtained, the trunk and/or the right sleeve and/or the left sleeve are already provided with a respective double hem on the lower end thereof.

In one aspect, the front side and the rear side represent two halves of the tubular textile article. As an alternative, depending on the type of garment to be made and on its shape, the front side and the rear side may not be exactly two halves of the tubular textile article; in this case the median plane does not go through the central axis.

In one aspect, said plurality of cutting lines comprises a fifth cutting line and a sixth cutting line, wherein:

the fifth cutting line starts from the upper edge of the front side of the tubular textile article, descends towards said lower edge to a specific height and re-ascends up to terminating on the upper edge of the rear side of the tubular textile article, said fifth cutting line being at least partially vertically superimposed on the right sleeve portion;

the sixth cutting line starts from the upper edge of the front side of the tubular textile article, descends towards said lower edge to a specific height and re-ascends up to terminating on the upper edge of the rear side of the tubular textile article, said sixth cutting line being at least partially vertically superimposed on the left sleeve portion;

wherein the fifth cutting line and the sixth cutting line are defined on opposite sides of the tubular textile article with respect to the central axis.

In one aspect, the fifth cutting line and the sixth cutting line intersect said median plane, preferably on two diametrically opposite points with respect to the central axis.

In one aspect, said specific heights to which the fifth cutting line and the sixth cutting line descend are the lowest points, i.e. closer to the lower edge and farther apart from the upper edge, reached by the fifth and sixth cutting line.

In one aspect, said specific heights to which the fifth cutting line and the sixth cutting line descend are located substantially on the median plane.

In one aspect, the fifth cutting line and the sixth cutting line are identical to one another and specular to a plane orthogonal to the median plane.

In one aspect, the fifth cutting line and the sixth cutting line are made up each of two halves identical to one another and specular to the median plane, wherein a first half is extended from the upper edge of the front side to said specific lower height, and a second half is extended from the upper edge of the rear side to said specific height, said two halves meeting in the point at said specific height.

In one aspect, following the step of cutting the tubular textile article along said fifth and sixth cutting lines:

a first upper piece, extended between the upper edge of the tubular textile article and the fifth cutting line and divided between the front side and the rear side, is removed, thus obtaining a front right shoulder margin, on said front side, and a rear right shoulder margin, on said rear side;

a second upper piece, extended between the upper edge of the tubular textile article and the sixth cutting line and divided between the front side and the rear side, is removed, thus obtaining a front left shoulder margin, on said front side, and a rear left shoulder margin, on said rear side.

In one aspect, in said step of joining said fabric portions of the tubular textile article:

the front right shoulder margin is joined with the rear right shoulder margin, by means of a fifth junction line which makes the right shoulder;

the front left shoulder margin is joined with the rear left shoulder margin, by means of a sixth junction line which makes the left shoulder;

in such a manner the fifth and the sixth junction lines complete the connection of the upper parts of the front trunk portion and of the rear trunk portion, thus making the shoulders at the top of the trunk of the garment.

In one aspect, the opening for the neck is present between the fifth junction line and the sixth junction line.

In one aspect, in said step of arranging a circular textile machine, such machine is a circular textile machine for seamless knitted items.

In the framework of the present invention, all the technical features described with reference to the process but also concerning the garment obtained by such process, i.e. that can be identified from a structural point of view in the garment itself, too, are to be considered as described and claimed also with reference to the garment only, considered per se. These technical features can concern e.g. the fabric portions, the trunk, the right sleeve, the left sleeve, the cutting lines, the junction lines, said double hems (or edges), said inserts, the shoulders of the garment, etc.

In an independent aspect thereof, the present invention relates to a garment, in particular a sweater or similar garment provided at least with a trunk, a right sleeve and a left sleeve, made by the process according to any one of the aspects and/or of the claims.

In an independent aspect thereof, the present invention relates to a garment, in particular a sweater or similar garment provided with at least a trunk, a right sleeve and a left sleeve, obtained from a tubular textile article, preferably by means of a circular textile machine, wherein the tubular textile article with which the garment is made has a shape substantially with cylindrical surface extended continuously a central axis of the article between an upper edge and a lower edge, and wherein on said tubular textile article a front side and a rear side are definable, divided from each other with respect to a median plane vertically dividing the tubular textile article substantially into two halves, corresponding to said front side and said rear side.

In one aspect, the tubular textile article of the garment is cut along a plurality of cutting lines in order to define and separate a plurality of fabric portions of the tubular textile article from each other, each fabric portion belonging to said front side, or to said rear side, or partially to the front side and partially to the rear side; wherein said fabric portions are separate from each other, by means of the cutting lines, but at least partially connected in the tubular textile article.

In one aspect, said fabric portions of the garment are joined, for example by means of seams, in order to obtain the trunk of the garment, the right sleeve and the left sleeve.

In one aspect, the garment obtained as a result of the joining of the fabric portions has passage zones between the trunk and the right and left sleeves lacking seams or discontinuities in the fabric, i.e. the passage from the fabric of the trunk to the fabric of the right and left sleeves occurs without interruptions.

In one aspect, the garment has its right and left sleeves that are longer than the trunk.

In one aspect, the respective lower ends of the right sleeve and of the left sleeve have a lengthwise extension that terminates, once the garment is completed, lower than the lower end of the trunk.

Each one of the aforesaid aspects of the invention can be considered alone or in combination with any one of the claims or of the other aspects as described.

Further characteristics and advantages shall be more evident from the detailed description of some embodiments, among which also a preferred embodiment, which are exemplary though not exclusive, of a process for making a garment and of a garment obtained by such process, according to the present invention.

DESCRIPTION OF THE DRAWINGS

This description shall be made below with reference to the accompanying drawings, provided to a merely indicative and therefore non-limiting purpose, in which.

DETAILED DESCRIPTION

Figure 1A:
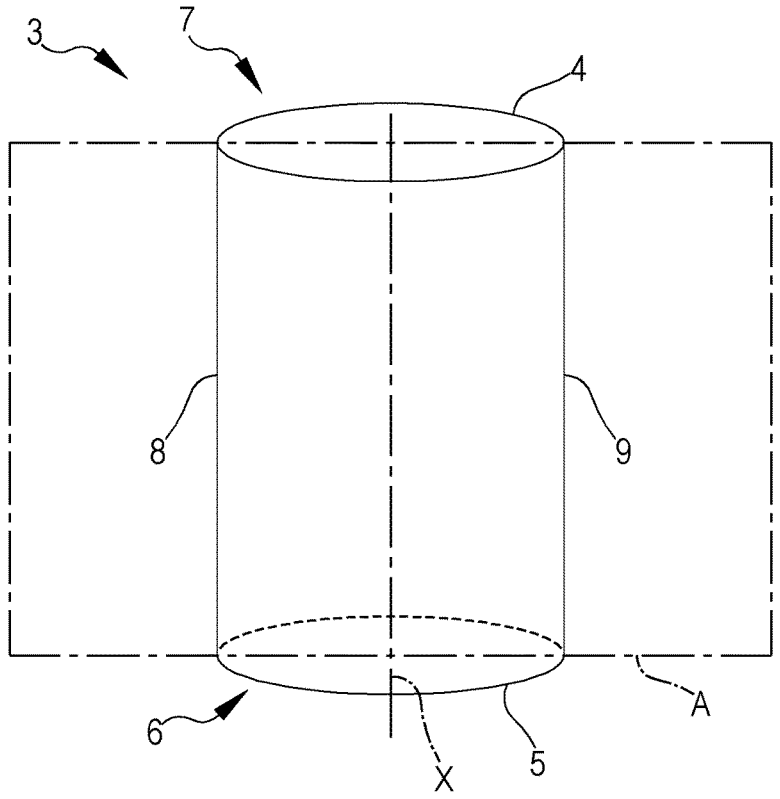
FIGS. 1A and 1B show a perspective view and a top view, respectively, of a tubular textile article, represented schematically, used in the process and in the garment according to the present invention.

With reference to the mentioned figures, the numeral 1 globally designates a garment according to the present invention. Generally, the same numeral is used for identical or similar elements, if applicable in their variants of embodiment.

Such garment 1 is in particular a sweater provided at least with a trunk T, a right sleeve MD and a left sleeve MS.

The garment can take the most various embodiments (T-shirts, sweaters, short or long sleeve shirts, etc.) having in common the structural presence of a trunk and two sleeves.

It should be noted that the term "trunk" is the same as "torso"; as a matter of fact, these terms identify both the user's body part and the portion of the garment 1 intended to be on (or cover) this body part.

The garment 1 shown in the figures is preferably made by the process forming the object of the present invention.

This method comprises at least the following steps:

arranging a circular textile machine;

producing a tubular textile article 3 by means of the aforesaid circular textile machine, having a shape substantially with cylindrical surface extended continuously around a central axis X of the article between an upper edge 4 and a lower edge 5; on the tubular textile article 3 a front side 6 and a rear side 7 are definable, divided from each other with respect to a median plane A; this median plane vertically divides the tubular textile article 3 substantially into two halves, corresponding to the front side 6 and to the rear side 7;

defining or identifying, on the tubular textile article 3, a plurality of cutting lines (51, 52, 53, 54; these cutting lines shall be disclosed in detail below).

The process can further comprise the following steps:

cutting the tubular textile article 3 along the plurality of cutting lines in order to define and separate a plurality of fabric portions (11, 21, 31, 41; these again shall be disclosed in detail below) of the tubular textile article 3 from each other, wherein these fabric portions are separated from each other, by means of the cutting lines, but they remain at least partially connected in the tubular textile article 3;

joining the fabric portions (11, 21, 31, 41) of the tubular textile article 3 in order to obtain the trunk T of the garment 1, the right sleeve MD and the left sleeve MS.

It should be noted that each fabric portion belongs either to the front side 6 or to the rear side 7, or partially to the front side 6 and partially to the rear side. In the latter case, the fabric portion is divided on both sides 6 and 7, i.e. it is made up of a part belonging to the front side 6 and of a part belonging to the rear side 7.

According to the process of the present invention, following the joining step, the garment 1 obtained from the tubular textile article 3 has zones of passage between the trunk T and the right MD and left MS sleeves lacking seams or discontinuities in the fabric, i.e. the passage from the fabric of the trunk T to the fabric of the right MD and left MS sleeves occurs without interruptions.

Figure 4:
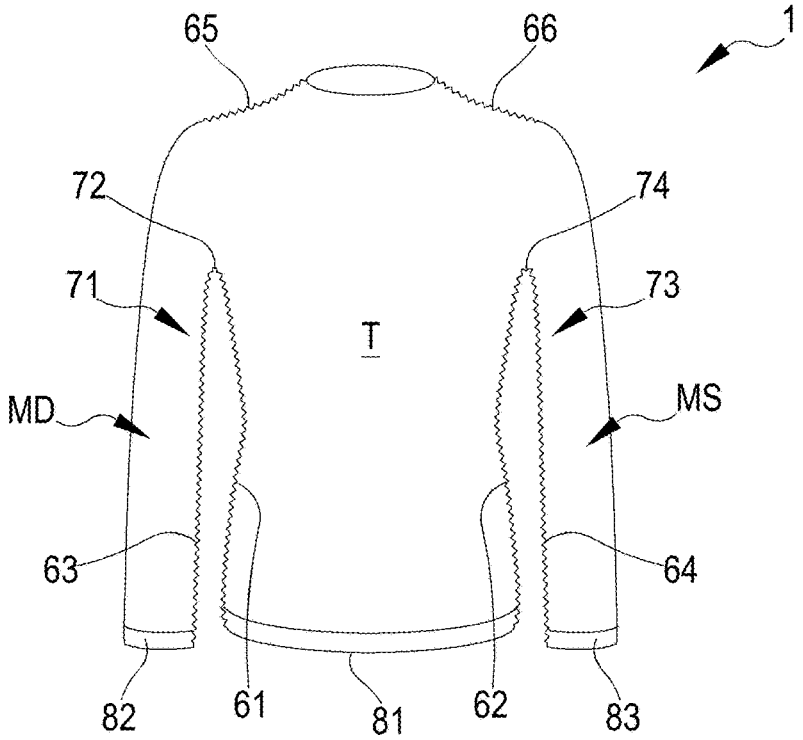
FIG. 4 shows a possible embodiment of a garment according to the present invention, obtained by means of the tubular textile article of FIG. 2 and according to the steps shown in FIGS. 2 and 3.
Figure 9:
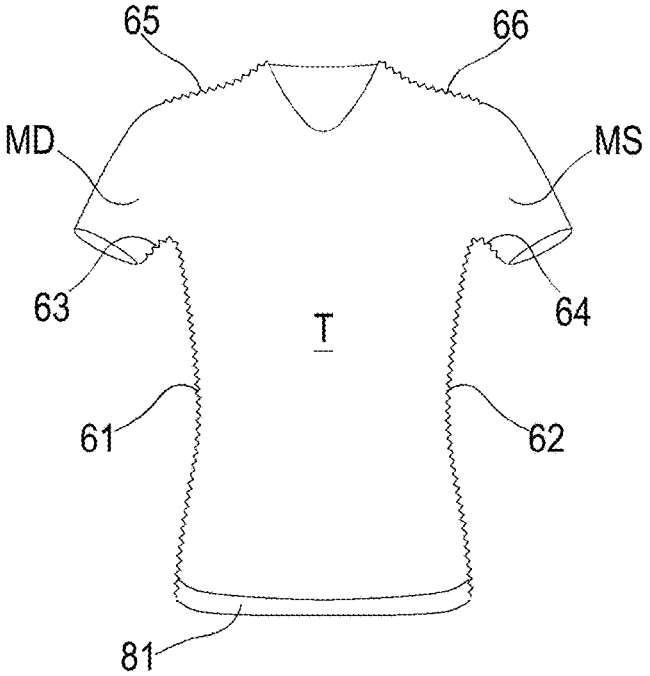
FIG. 9 shows a garment according to the present invention, obtained from the tubular textile article of FIGS. 7 and 8.
Figure 11:
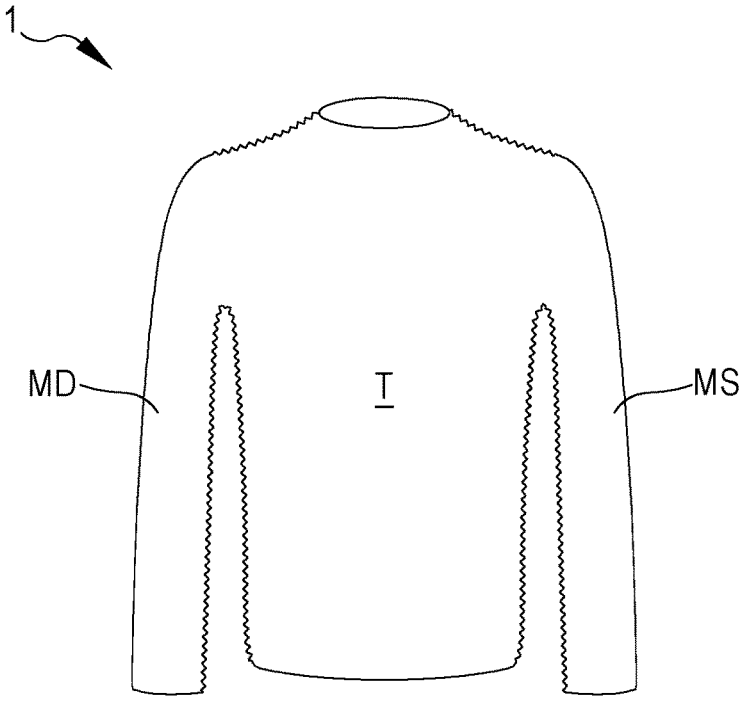

As can be observed by way of example in the various embodiments of FIGS. 4, 9 and 11, the aforesaid zones of passage between the trunk T and the right MD and left MS sleeves are the zones of the garment located both on the front side, between shoulder and armpit, and similarly on the rear side. Basically, the garment 1 does not exhibits seams, discontinuities or joints, either on the right armhole or on the left armhole. In other words, the garment according to the present invention does not have armholes as typically present in known solutions. This means that, both on the front and on the back of the garment, there is a direct (continuous) passage of the fabric from the trunk to the sleeves, without the presence of right or left armhole.

The tubular textile article 3 is preferably made by means of a circular textile machine, provided with a needle-holding cylinder housing a plurality of needles and able to rotate around a main axis of the needle-holding cylinder.

The needle-holding cylinder can exhibit a variable diameter depending on the textile needs or on the size to be obtained for the tubular textile article (e.g. the diameter thereof). More to the point, the diameter of the needle-holding cylinder can be selected based on the size of the garment to be made starting from the tubular textile article.

By way of example, the diameter of the needle-holding cylinder can be 4 inches, 8 inches, 16 inches, 24 inches, etc. The needle-holder cylinder can also be a needle-holder plate.

The knitting machine and its components (needle-holder cylinder, control members, processing unit, etc.) are not shown in detail in the figures, since they are known per se and of conventional type. From the point of view of the textile technology, the operation of the whole textile machine (e.g. the interaction of control elements and needles, the cooperation between needles and threads, etc.) is not described in detail since it is known in the technical field of the present invention.

Preferably, in the step of arranging a circular textile machine, such machine is a circular textile machine for seamless knitted items.

In the context of the present description, the use of terms such as "front", "rear", "radial", "upper", "lower", "horizontal", "vertical", "frontal" and similar words relates, unless otherwise specified, to a spatial orientation which the object of the invention can normally take in operating or use conditions. For instance, the axial direction is always considered with reference to the central axis X of the tubular textile article 3 which the garment 1 intended to be worn in the configuration shown in FIG. 4, 9 or 11 is made with.

Figure 1B:
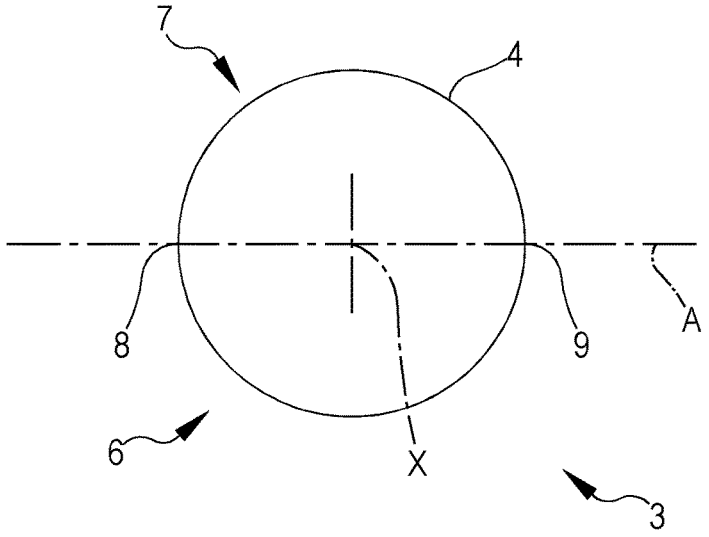

The structure and the respective elements of the tubular textile article 3 are shown schematically in FIGS. 1A and 1B.

Figure 3:
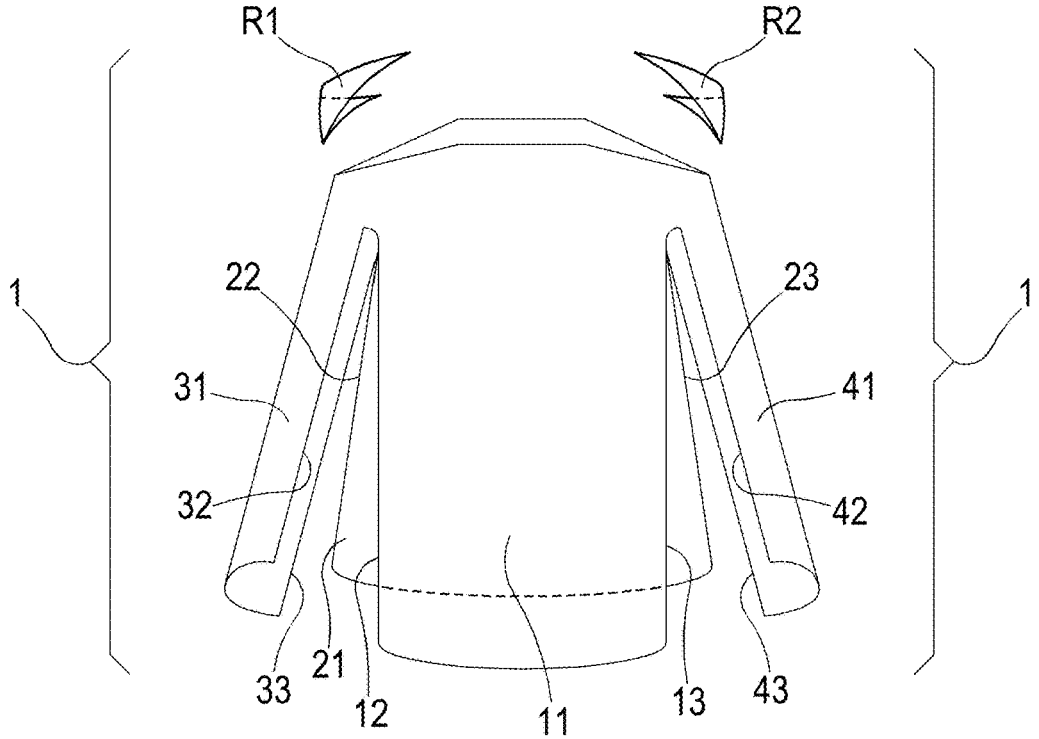
FIG. 3 shows a further perspective view of a tubular textile article of FIG. 2 and discloses some following steps of the process for making a garment according to the present invention.

Preferably, as shown by way of example in FIG. 3, the aforesaid portions comprise at least:

a front trunk portion 11, belonging to the front side 6 of the tubular textile article 3;

a rear trunk portion 21, belonging to the rear side 7 of the tubular textile article 3;

a right sleeve portion 31, comprising fabric both of the front side 6 and of the rear side 7, and intersecting the median plane A;

a left sleeve portion 41, comprising fabric both of the front side 6 and of the rear side 7, and intersecting the median plane A on the opposite side of the central axis X with respect to the right sleeve portion.

Preferably, the step of joining the fabric portions comprises the following steps:

joining the front trunk portion 11 to the rear trunk portion 21 in order to make the trunk T of the garment, the trunk T having at least partially tubular shape;

closing the right sleeve portion 31 on itself for making a right sleeve MD, the right sleeve MD having at least partially tubular shape;

closing the left sleeve portion 41 on itself for making a left sleeve MS, the left sleeve MS having at least partially tubular shape.

Preferably, the front trunk portion 11 and the rear trunk portion 21 are separated from one another by the left sleeve portion MS and the right sleeve portion MD.

Preferably, the step of cutting the tubular textile article 3 creates, by following a circumferential extension of the tubular textile article around the central axis X, an alternation between a trunk portion (11 or 21) and a sleeve portion (31 or 41).

Preferably, the step of cutting the tubular textile article 3 creates, by following a circumferential extension of the tubular textile article around the central axis X, the following alternation of portions: front trunk portion 11, right sleeve portion 31, rear trunk portion 21, left sleeve portion 41.

Preferably, the median plane A of the tubular textile article 3 passes through the central axis X (as shown by way of example in FIG. 1B) or is parallel thereto. It should be noted that both the central axis X and the median plane A are oriented in the same direction as the longitudinal development of the tubular textile article, i.e. from the upper edge to the lower edge (or vice versa).

Preferably, the front side 6 and the rear side 7 develop in a continuous manner one after the other, thus forming the aforesaid cylindrical surface of the tubular textile article 3.

Preferably, the lower edge 5 and the upper edge 4 have a substantially circumferential shape.

It should be noted that, in accordance with the orientation of the tubular textile article and of the garment shown in the figures, the lower edge 5 is above and the upper edge 4 is below: however, the tubular textile article 3 can be turned upside down (i.e. rotated of 180°, i.e. the two edges can be inserted without consequences on the implementation of the invention.

By way of example, the lower edge can correspond to the part which the production of the tubular textile article begins with, whereas the upper edge corresponds to the terminal part of the tubular textile article; or vice versa.

Preferably, in the step of producing a tubular textile article 3 a single tubular textile article 3 is produced, which allows to make trunk T and right MD and left MS sleeves of the garment 1 as one piece.

Preferably, the trunk T, the right sleeve MD and the left sleeve MS are globally at least partially joined and continuous one after the other in a one-piece fabric.

Preferably, the trunk T, the right sleeve MD and the left sleeve MS, belonging to the same tubular textile article 3, are never detached or separate from one another; the garment is made as one piece starting from the tubular textile article.

Preferably, the fabric portions 11, 21, 31 and 41, as a result of the step of cutting the tubular textile article 3, are not divided or separated completely from one another, but remain at least partially joined in the one-piece tubular textile article.

Preferably, the front side 6 is always at least partially connected in a continuous manner to the rear side 7 of the tubular article 3, also as a result of the cuts made along the cutting lines. In particular, the front side 6 and the rear side 7 remain connected in the high part of the torso and in the areas around the shoulders of the garment.

Preferably, from the step of producing the tubular textile article to the end of the step of making or manufacturing the garment, there is never a step of longitudinally cutting the tubular textile article from the lower edge to the upper edge (or vice versa) or a step of opening the tubular textile article obtaining a flat (and not a cylindrical) piece of fabric.

Preferably, in the step of producing a tubular textile article, such tubular textile article 3 is a single layer fabric.

As an alternative, in the step of producing a tubular textile article, the tubular textile article can be a double layer fabric.

Preferably, the step of defining or identifying on the tubular textile article 3 a plurality of cutting lines (51, 52, 53, 54) is implemented by executing one or more of the following operations:

- designing on the tubular textile article 3, in construction step (i.e. when making the fabric), the cutting lines, for example by means of threads of a different color with respect to the adjacent portions of the tubular textile article;
- showing or projecting on the tubular textile article 3, before and/or during the step of cutting the tubular textile article, the cutting lines, for example by means of an optical light or laser device capable of defining and rendering the cutting lines visible;
- programming a machine for automated cutting, defining at its interior, for example in a control software for such machine, the cutting lines such that it can operate on the tubular textile article 3 and automatically make the cutting lines;
- tracing on the tubular textile article 3, before and/or during the step of cutting the tubular textile article, the cutting lines.

In one possible embodiment, the step of defining or identifying a plurality of cutting lines on the tubular textile article can be carried out directly during the step of cutting the tubular textile article, e.g. manually by an operator.

Preferably, the cutting lines (51, 52, 53, 54) all start from the lower edge 5 of the tubular textile article 3 and develop towards the upper edge 4.

Preferably, the cutting lines developing from the lower edge 5 end into the tubular textile article 3 before reaching the upper edge, i.e. they do not end or lead onto the upper edge 4.

Preferably, as shown by way of example in FIGS. 2 and 5-8, the cutting lines (51, 52, 53, 54) are interrupted in an intermediate portion of the tubular textile article 3 between the lower edge 5 and the upper edge 4.

Preferably, in the step of cutting the tubular textile article 3, the cutting lines do not (never) cause the tubular article to be opened, i.e. the textile article maintains at least one continuous tubular fabric portion which is closed all around the central axis X. In other words, the cutting lines are never such as to make the textile article a sheet fabric, i.e. no longer tubular.

Preferably, none of the cutting lines (51, 52, 53, 54) develops between or joins the lower edge 5 and the upper edge 4.

Preferably, the cutting lines (51, 52, 53, 54) develop longitudinally from the lower edge 5 of the tubular textile article 3 following a direction that substantially corresponds to the longitudinal development of the tubular textile article from the lower edge to the upper edge 4, i.e. corresponding or parallel to the central axis X of the tubular textile article.

Preferably, the step of joining the fabric portions (11, 21, 31, 41) occurs by means of several seams, or similar, between the fabric portions to be joined.

Preferably, each of the cutting lines creates, as a result of the cutting operation executed along the line, two fabric margins belonging to two adjacent fabric portions, the two margins being at the sides of the cutting line.

Figure 2:
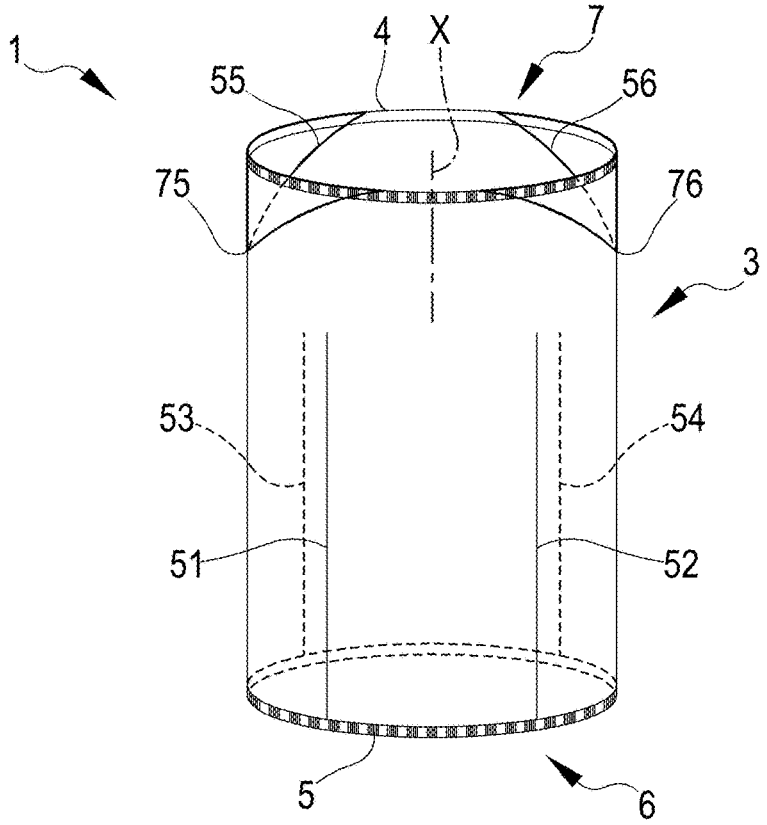
FIG. 2 shows a perspective view of a tubular textile article, represented schematically, disclosing some steps of the process for making a garment according to the present invention, in accordance with a possible embodiment.

Reference should be made in particular to FIGS. 2 and 3.

Preferably, the plurality of cutting lines comprises at least one first cutting line 51, one second cutting line 52, one third cutting line 53 and one fourth cutting line 54, wherein:

- the first cutting line 51 is positioned on the front side 6 of the tubular textile article 3 and separates the front trunk portion 11 and the right sleeve portion 31 from each other, thus creating a right margin 12 of the front trunk portion 11 and a front margin 32 of the right sleeve portion 31 (both margins are on the front side);

the second cutting line 52 is positioned on the front side 6 of the tubular textile article 3 and separates the front trunk portion 11 and the left sleeve portion 41 from each other, thus creating a left margin 13 of the front trunk portion 11 and a front margin 42 of the left sleeve portion 41 (both margins are on the front side);

the third cutting line 53 is positioned on the rear side 7 of the tubular textile article 3 and separates the rear trunk portion 21 and the right sleeve portion 31 from each other, thus creating a right margin 22 of the rear trunk portion 21 and a rear margin 33 of the right sleeve portion 31 (both margins are on the rear side);

the fourth cutting line 54 is positioned on the rear side 7 of the tubular textile article 3 and separates the rear trunk portion 21 and the left sleeve portion 41 from each other, thus creating a left margin 23 of the rear trunk portion 21 and a rear margin 43 of the left sleeve portion 41 (both margins are on the rear side).

Preferably, following the step of cutting the tubular textile article along the first 51, second 52, third 53 and fourth 54 cutting lines:

the front trunk portion 11 is laterally extended between its right margin 12 and its left margin 13 and is entirely on the front side 6;

the rear trunk portion 21 is laterally extended between its right margin 22 and its left margin 23 and is entirely on the rear side 7;

the right sleeve portion 31 is laterally extended between its front margin 32 and its rear margin 33 and is thus shared between the front side 6 and the rear side 7;

the left sleeve portion 41 is laterally extended between its front margin 42 and its rear margin 43 and is thus shared between the front side 6 and the rear side 7.

"Shared between the front side and the rear side", referring both to the right sleeve portion 31 and to the left sleeve portion 41, means that the portion is half made up of fabric of the front side 6 and half of fabric of the rear side 7, with a continuous, seamless passage between the half on the front side and the half on the rear side.

"Laterally extended" means perpendicularly to the direction of development of the tubular article, or according to a circumferential (or angular) direction around the central axis.

Preferably, as shown by way of example in the figures, each of said first 51, second 52, third 53 and fourth 54 cutting lines has a linear development, possibly with curves, from its beginning on the lower edge 5 to its end point in the respective side of the tubular textile article 3.

In one possible alternative embodiment (not shown), one or more of said first, second, third and fourth cutting lines can be shaped as an elongated upside down "V", wherein said "V" is obtained starting from the lower edge of the tubular article, up towards the upper edge as far as a given (maximum) point and then down until ending again onto the lower edge, in a point at a lateral distance from the starting point, so as to create a "V"-shaped fabric piece corresponding to the shape defined by the cutting line.

Substantially, when the cutting line is linear, the cut creates directly the two margins on the right and left of the line itself, whereas when the cutting line is "V" shaped, the cut, while creating the two right and left margins, removes the V-shaped fabric piece contained inside the "V"-shaped cutting line and comprised between the two margins thus obtained.

It should be noted that, if a cutting line is "V" shaped, the top point of such "V", i.e. the maximum point reached by the cutting line when ascending towards the upper edge before re-descending again to the lower edge, will be an armpit point in the manufactured garment. The "V" line, starting from the top point, will then widen while it descends towards the lower edge of the tubular element.

The definition of "V" instead of linear cutting lines, and the subsequent removal of the material included in the "V"s during the cutting operation, allows to obtain specific shaped in the garment once manufactured. For instance, the "V" shape of the cutting lines allows to obtain side cuts on the trunk, i.e. hollows on the sides which make the garment adhering and well fitted to the person, in particular to the part adhering to the waist.

In addition, the "V" shape of the cutting lines can also allow to obtain a specific narrowing of the diameter of the sleeves towards the wrists.

In accordance with possible embodiments, one or more of the cutting lines can be variously shaped or undulated in order to obtain a specific three-dimensional shape of the trunk and of the sleeves in the finished garment.

Reference should now be made in particular to FIGS. 3 and 4.

Preferably, in the step of joining the fabric portions of the tubular textile article:

the right margin 12 of the front trunk portion 11 is joined with the respective right margin 22 of the rear trunk portion 21, by means of a first junction line 61;

the left margin 13 of the front trunk portion 11 is joined with the respective left margin 23 of the rear trunk portion 21, by means of a second junction line 62.

Thus, the first 61 and the second 62 junction line complete the connection of the front trunk portion 11 with the rear trunk portion 21, thus making the trunk T of the garment 1.

Preferably, in the step of joining the fabric portions of the tubular textile article:

the front margin 32 of the right sleeve portion 31 is joined with the rear margin 33 of the same right sleeve portion 31, by means of a third junction line 63;

the front margin 42 of the left sleeve portion 41 is joined with the rear margin 43 of the same left sleeve portion 41, by means of a fourth junction line 64.

Thus, the third junction line 63 closes and completes the right sleeve MD of the garment, and the fourth junction line 64 closes and completes the left sleeve MS of the garment.

Preferably, the first junction line 61, the second junction line 62, the third junction line 63 and the fourth junction line 64 are seams made between the two involved fabric margins. As an alternative to sewing, each junction line can be obtained with analogous methods, e.g. as taping, gluing or welding.

It should be noted that the first junction line 61 represents a right side line (or seam) of the trunk T, and the second junction line 62 presents a left side line (or seam) of the trunk T.

It should further be noted that the third junction line 63 represents an inner line (or seam) of the right sleeve MD (pointing to the right side of the trunk), and the fourth junction line 64 represents an inner line (or seam) of the left sleeve MS (pointing to the left side of the trunk).

In one possible embodiment (shown by way of example in FIG. 4), the first junction line 61 and the third junction line 63 are located in series to one another, in a continuous manner, so as to form a continuous (seamless) right junction line 71. In this case, an upper end of the first junction line 61 coincides with an upper end of the third junction line 63, so that one can pass seamlessly from the first junction line to the third junction line (or vice versa). Preferably, this point of passage (identified with numeral 72 in FIG. 4) from the first junction line 61 to the third junction line 63 is designed to be in a position corresponding, with the garment in use, to the user's right armhole.

Preferably, the upper end of the first junction line 61 and the upper end of the third junction line 63 correspond to the respective terminal points both of the first cutting line 51 and of the third cutting line 53 (as can be seen from the sequence of operations shown in FIGS. 2, 3 and 4).

Preferably, the lower end of the first junction line 61 connects the lower point of the right margin 12 of the front trunk portion 11 and the lower point of the right margin 22 of the rear trunk portion 21, both these lower points being placed on the lower edge 5 of the tubular textile article 3.

Preferably, the lower end of the third junction line 61 connects the lower point of the front margin 32 of the right sleeve portion 31 and the lower point of the rear margin 33 of the right sleeve portion 31, both these lower points being placed on the lower edge 5 of the tubular textile article 3.

Preferably, the right junction line 71 develops, preferably in a seamless manner, starting from the lower end of the first junction line 61, proceeds (up towards the upper edge 4 of the tubular textile article) as far as said point of passage 72 from the first junction line to the third junction line, then further proceeds (down towards the lower edge 5 of the tubular textile article) as far as said lower end of the third junction line 63, where it ends.

In one possible embodiment (shown by way of example in FIG. 4), the second junction line 62 and the fourth junction line 64 are located in series to one another, in a continuous manner, so as to form a continuous (seamless) left junction line 73. In this case, an upper end of the second junction line 62 coincides with an upper end of the fourth junction line 64, so that one can pass seamlessly from the second junction line to the fourth junction line (or vice versa). Preferably, this point of passage (identified with numeral 74 in FIG. 4) from the second junction line 62 to the fourth junction line 64 is designed to be in a position corresponding, with the garment in use, to the user's left armhole.

Preferably, the upper end of the second junction line 62 and the upper beginning of the fourth junction line 64 correspond to the respective terminal points both of the second cutting line 52 and of the fourth cutting line 54 (as can be seen from the sequence of operations shown in FIGS. 2, 3 and 4).

Preferably, the lower end of the second junction line 62 connects the lower point of the left margin 13 of the front trunk portion 11 and the lower point of the left margin 23 of the rear trunk portion 21, both these lower points being placed on the lower edge 5 of the tubular textile article 3.

Preferably, the lower end of the fourth junction line 64 connects the lower point of the front margin 42 of the left sleeve portion 41 and the lower point of the rear margin 43 of the left sleeve portion 41, both these lower points being placed on the lower edge 5 of the tubular textile article 3.

Preferably, the left junction line 73 develops, preferably in a seamless manner, starting from the lower end of the second junction line 62, proceeds (up towards the upper edge 4 of the tubular textile article) as far as said point of passage 74 from the second junction line to the fourth junction line, then further proceeds (down towards the lower edge 5 of the tubular textile article) as far as said lower end of the fourth junction line 64, where it ends.

In one possible embodiment (not shown), the process comprises the steps of:

applying a right insert to the tubular textile article 3, in a position comprised between the first junction line 61 and the third junction line 63, in a manner such that the right insert is interposed between, and connecting, said first junction line (in particular the upper end of the first junction line) and said third junction line (in particular the upper end of the third junction line); the right insert is intended to be, with garment in use, on the user's right armhole;

applying a left insert to the tubular textile article 3, in a position comprised between the second junction line 62 and the fourth junction line 64, in a manner such that the left insert is interposed between, and connecting, said second first junction line (in particular the upper end of the second junction line) and said fourth junction line (in particular the upper end of the fourth junction line); the left insert is intended to be, with garment in use, on the user's left armhole.

Preferably, the right insert and the left insert are configured for eliminating discontinuities that can be present between the first 61 and the third 63 junction line and between the second 62 and the fourth 64 junction line, respectively.

Preferably, the right insert and the left insert are configured for avoiding the presence of junction lines, e.g. seams, in the two zones of the garment intended to be, with the garment in use, on the user's armholes.

Thus, eliminating the seams in the armpit areas, which as is known are delicate and subject to sweating and rubbing on the garment, the comfort and wearability of the garment can be increased. These inserts avoid or reduce irritation phenomena that can occur in these areas or a discomfort for the user due to the garment worn during use. This is particularly relevant if the garment is worn for longer periods and/or when making sports.

Preferably, the right insert and the left insert are configured for suitably shaping the garment 1 in the two zones of the garment itself intended to be with the garment in use, on the user's armholes. Thus, a three-dimensional, more ergonomic or comfortable shape of the garment in its portions corresponding to the user's armholes can be obtained. By way of example, the right insert and the left insert are configured for widening the zones corresponding to the user's armholes.

The right insert and the left insert can be obtained from the same tubular textile article on which the fabric portions forming the trunk, the right and left sleeves are defined, e.g. from waste portions obtained after the cutting step.

In one possible embodiment, the right insert and the left insert are made of breathable fabric.

In one possible embodiment, the right insert and the left insert are made of reinforcing fabric.

In one possible embodiment (not shown), the process comprises the step of applying to the tubular textile article one or more inserts in specific positions along one or more junction lines.

Preferably, each of said inserts is intended to be interposed along a specific junction line, locally interrupting, on the position where it is located, the continuity of such junction line.

Preferably, if the junction line is a seam, such insert can locally interrupt or open the seam; in particular is interrupted at the beginning of the insert, proceeds on the sides of the itself and is resumed at the end of the insert.

For instance, a first insert can be inserted along the first junction line 61 so as to provide the garment with a right side insert.

For instance, a second insert can be inserted along the third junction line 63 so as to provide the garment with a left side insert.

Similar inserts can be positioned and inserted e.g. on the junction lines on the shoulders (fifth 65 and sixth 66 junction line) or on the inner junction lines of the sleeves (second 62 and fourth 64 junction line).

Preferably, said insert is configured for suitably shaping the garment 1 in the zone of the garment itself where it is positioned, and/or for providing such zone with particular characteristics of elasticity or compression or breathability and/or specific aesthetic or technical characteristics.

The presence of inserts in the garment can increase comfort or wearability and/or improve its aesthetic and/or technical features (e.g. body support, transpiration, etc.).

Figure 10:
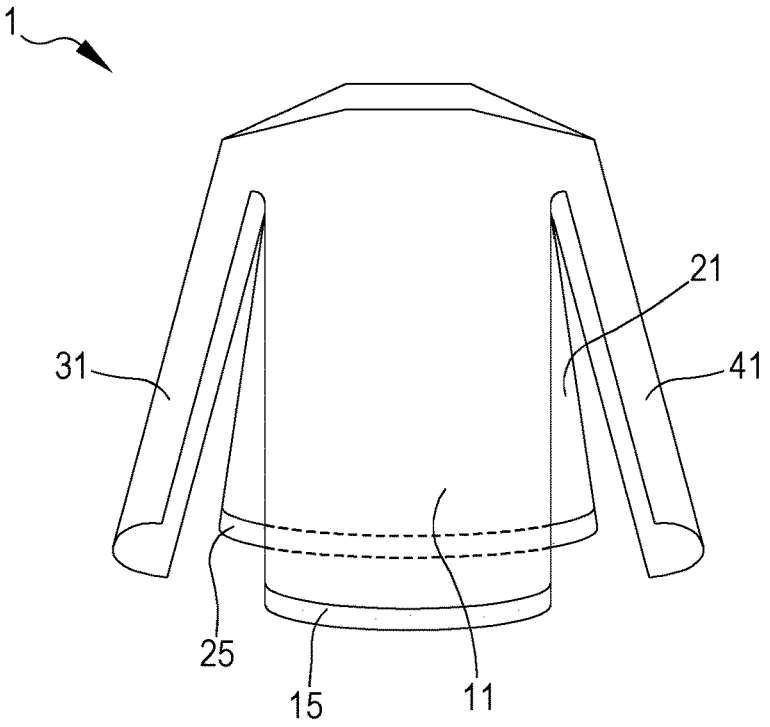
FIGS. 10 and 11 show in a schematic manner a perspective view of a tubular textile article and of a garment, respectively, according to the present invention, in accordance with a further possible embodiment.

Reference should now be made in particular to FIGS. 10 and 11.

According to a possible embodiment, the process includes a step of suitably sizing the trunk T and the right MD and left MS sleeves in a manner such that the right and left sleeves are longer than the trunk of the garment.

Preferably, the respective lower ends of the right sleeve MD and of the left sleeve MS have a lengthwise extension that terminates, once the garment 1 is completed, lower than the lower end of the trunk T.

This allows to make sweaters having a wearability that is more suited to the user's body, and in particular allows to correctly cover the user's arms and torso, up to the most suitable length.

It should be noted that sleeves that are longer than the trunk means that the two right and left sleeves MD and MS proceed, in the lower part of the garment 1, as far as a point, at a distance from the top of the garment (with shoulders and neck), that is higher than the point reached by the lower end of the trunk T (always referred to the top of the garment).

The sizing step can be executed in the step of producing the tubular textile article 3, in a manner such that the parts (31, 41) of the tubular textile article intended, following the cuts, to form the right sleeve portion 31 and the left sleeve portion 41 are longer than the parts (11, 21) of the tubular textile article intended, following the cuts, to form the front trunk portion 11 and the rear trunk portion 21.

According to a variant of embodiment (see FIG. 10), the sizing step can comprise a step of removing a lower section 15 of the front trunk portion 11 and a lower section 25 of the rear trunk portion 21, in a manner such to shorten such portions with respect to the right sleeve 31 and left 41 sleeve portions, obtaining a trunk T that is shorter than the right MD and left MS sleeves. Preferably, the length reduction of the front trunk portion 11 and the length reduction of the rear trunk portion 21 are identical to one another; in this case, the two lower sections 15 and 25 removed from the two trunk portions are substantially identical.

Preferably, in the step of removing a lower section 15 of the front trunk portion 11 and a lower section 25 of the rear trunk portion 21, the sections removed are horizontal strips cut starting from the lower edge 5 of the tubular textile article 3. In this case, a result of the front trunk portion 11 and of the rear trunk portion 21 being reduced in length, the original lower edge 5 of the textile article, as obtained from the step for producing the same, is left only on the lower ends of the right sleeve MD and of the left sleeve MS.

The process can comprise a step of making a double hem 81 on the lower edge of the trunk T of the garment.

Preferably, the process can comprise a step of making respective double hems 82 and 83 on the respective lower ends of each of the two right MD and left MS sleeves.

A double hem, or double edge, is also known as a "cuff" in the field, and is typically obtained by folding the fabric of an edge onto itself and joining with stitches the folded part, so as to obtain a strip or band made of double fabric on the edge.

The step of making a double hem can be performed simultaneously with the step of producing the tubular textile article 3, by making a double fabric, or cuff, on the lower edge 5 of the tubular textile article. Thus, the tubular textile article is already produced with the entire lower edge made of double fabric for the entire circumferential extension thereof and, following the steps of cutting the tubular textile article 3 and joining the fabric portions obtained, the trunk T and/or the right sleeve MD and/or the left sleeve MS are already provided with a respective double hem on the lower end thereof.

A double hem made simultaneously with the step of producing the tubular textile article allows to obtain a sweater that is already provided with a lower edge for the trunk and with two cuffs for the sleeves, without the need for these finishing operations to be added in following manufacturing steps.

Preferably, the front side 6 and the rear side 7 represent two halves of the tubular textile article. As an alternative, depending on the type of garment to be made and on its shape, the front side 6 and the rear side 7 may not be exactly two halves of the tubular textile article; in this case the median plane A does not go through the central axis X.

In any case, the median plane A vertically cuts the tubular textile article (having a cylindrical shape) and sections it on two longitudinal lines 8 and 9 developing parallel to the central axis X.

The two longitudinal lines 8 and 9 are placed between and connect the two front and rear sides of the tubular textile article and are shared between them.

Preferably (as shown by way of example in FIGS. 2, 5 and 7), the plurality of cutting lines comprises a fifth cutting line 55 and a sixth cutting line 56, wherein:

- the fifth cutting line 55 starts from the upper edge 4 of the front side 6 of the tubular textile article, descends towards the lower edge 5 to a specific lower height (referred with numeral 75 in the figures) and re-ascends up to terminating on the upper edge 4 of the rear side 7 of the tubular textile article; the fifth cutting line 55 is at least partially vertically superimposed on the right sleeve portion 31;
- the sixth cutting line 56 starts from the upper edge 4 of the front side 6 of the tubular textile article, descends towards the lower edge 5 to a specific lower height (referred with numeral 76 in the figures) and re-ascends up to terminating on the upper edge 4 of the rear side 7 of the tubular textile article; the sixth cutting line 56 is at least partially vertically superimposed on the left sleeve portion 41.

The fifth cutting line 55 and the sixth cutting line 56 are preferably defined on opposite sides of the tubular textile article 3 with respect to the central axis X.

Preferably, the fifth cutting line 55 and the sixth cutting line 56 intersect the median plane A, preferably on two diametrically opposite points with respect to the central axis X.

Preferably, the specific lower heights 75 and 76 to which the fifth cutting line 55 and the sixth cutting line 56 descend are the lowest points, i.e. closer to the lower edge 5 and farther apart from the upper edge 4, reached by the fifth 55 and sixth 56 cutting line. Preferably, the specific heights to which the fifth cutting line 55 and the sixth cutting line 56 descend are located substantially on the median plane A.

Preferably, the fifth cutting line 55 and the sixth cutting line 56 are identical to one another and specular to a plane orthogonal to the median plane A.

Preferably, the fifth cutting line 55 and the sixth cutting line 56 are made up each of two halves identical to one another and specular to the median plane A, wherein a first half is extended from the upper edge 4 of the front side 6 to said specific height (75 or 76), and a second half is extended from the upper edge 4 of the rear side 7 to said specific height (75 or 76), and these two halves meet in the point at said specific height.

Preferably (see FIG. 3), following the step of cutting the tubular textile article along the fifth cutting line 55 and the sixth cutting line 56:

- a first upper piece R1, extended between the upper edge 4 of the tubular textile article 3 and the fifth cutting line 55 and divided between the front side 6 and the rear side 7, is removed, thus obtaining a front right shoulder margin, on the front side 6, and a rear right shoulder margin, on the rear side 7;
- a second upper piece R2, extended between the upper edge 4 of the tubular textile article 3 and the sixth cutting line 56 and divided between the front side 6 and the rear side 7, is removed, thus obtaining a front left shoulder margin, on the front side 6, and a left right shoulder margin, on the rear side 7.

Preferably, in the step of joining the fabric portions of the tubular textile article 3:

- the front right shoulder margin is joined with the rear right shoulder margin, by means of a fifth junction line 65 which makes the right shoulder;
- the front left shoulder margin is joined with the rear left shoulder margin, by means of a sixth junction line 66 which makes the left shoulder.

Thus, the fifth junction line 65 and the sixth junction line 66 complete the connection of the upper parts of the front trunk portion 11 and of the rear trunk portion 21, thus attaining the shoulders at the top of the trunk T of the garment 1.

Preferably, the opening for the neck is present between the fifth junction line 65 and the sixth junction line 66.

It should be noted that, preferably, the fifth 55 and the sixth 56 cutting lines, which define the margins which once joined form the shoulders of the sweater, are located substantially above the right and left sleeves MD and MS, so that shoulders and sleeves are in the correct positions once the sweater is completed. Typically, the bottom points 75 and 76 of the fifth cutting line 55 and of the sixth cutting line 56 (i.e. the aforesaid specific heights to which the cutting lines descend) are substantially aligned above a median zone of the sleeves (right and left, respectively), i.e. vertically half way between the front margin and the rear margin of the respective sleeve portion (right and left, respectively).

In the framework of the present invention, all the technical features described with reference to the process but also concerning the garment obtained by such process, i.e. that can be identified from a structural point of view in the garment itself, too, are to be considered as described and claimed also with reference to the garment only, considered per se. These technical features can concern e.g. the fabric portions, the trunk, the right sleeve, the left sleeve, the cutting lines, the junction lines, said double hems (or edges), said inserts, the shoulders of the garment, etc.

Various types of garments 1, provided at least with a trunk (T), a right sleeve (MD) and a left sleeve (MS), and made by the process of the present invention, are shown in the figures.

Figure 5:
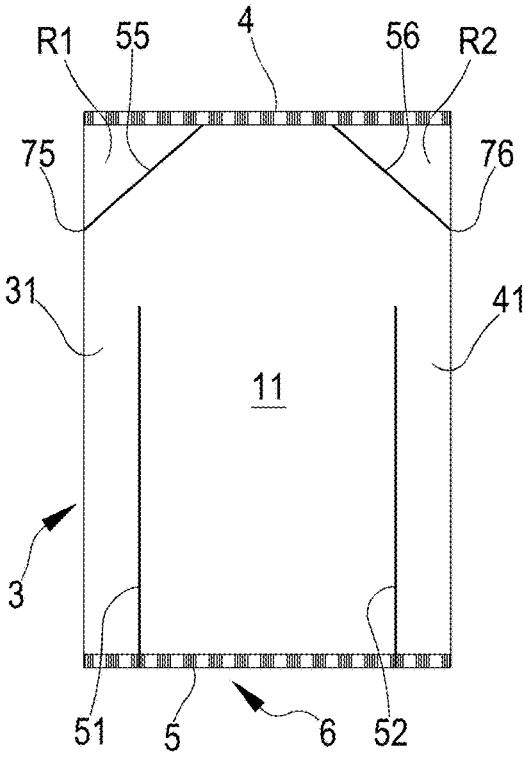
FIG. 5 shows in a schematic front view a tubular textile article disclosing the implementation of the process according to the present invention, in order to obtain a garment according to a possible embodiment.

For instance, FIG. 5 shows in a schematic manner a tubular textile article 3 with the front side 6 stretched and "flattened" on the rear side 7; basically, it is as if the tubular textile article 3 had been "flattened" along the median plane A, thus being planar and "double layer" (front side on rear side). This figure shows the "design" of the tubular textile article (in particular the definition of the cutting lines) and corresponds to what is shown in FIGS. 2 and 3 (process steps) and in FIG. 4 (garment).

Figure 6:
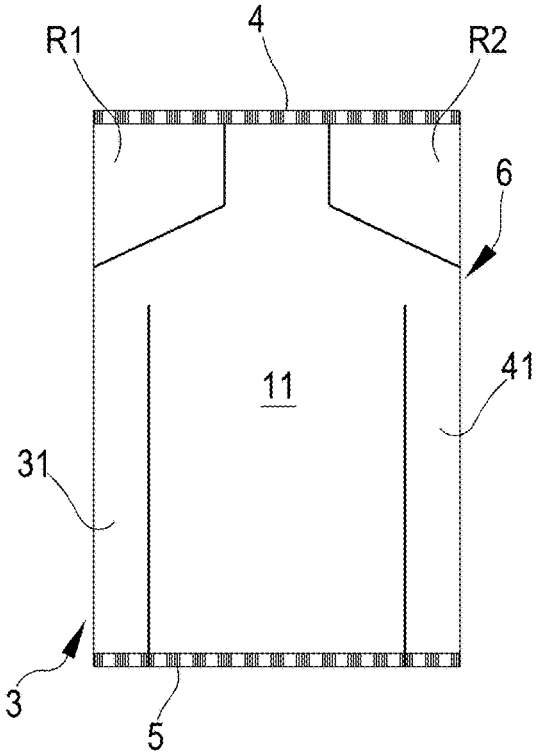
FIG. 6 shows in a schematic front view a tubular textile article disclosing a further example of implementation of the process according to the present invention in order to obtain a garment according to a further possible embodiment.

Conversely, FIG. 6 shows, still in a schematic manner, a tubular textile article 3 according to a different embodiment: in this case it is a "mock turtleneck" or "turtleneck" sweater, i.e. with a high (or elongated) neck.

The process is the same as described before, with the difference that the fifth cutting line 55 and the sixth cutting line 56 are shaped differently and reach a deeper level, starting from the upper edge 4 towards the lower edge 5 of the tubular textile article 3.

Figure 7:
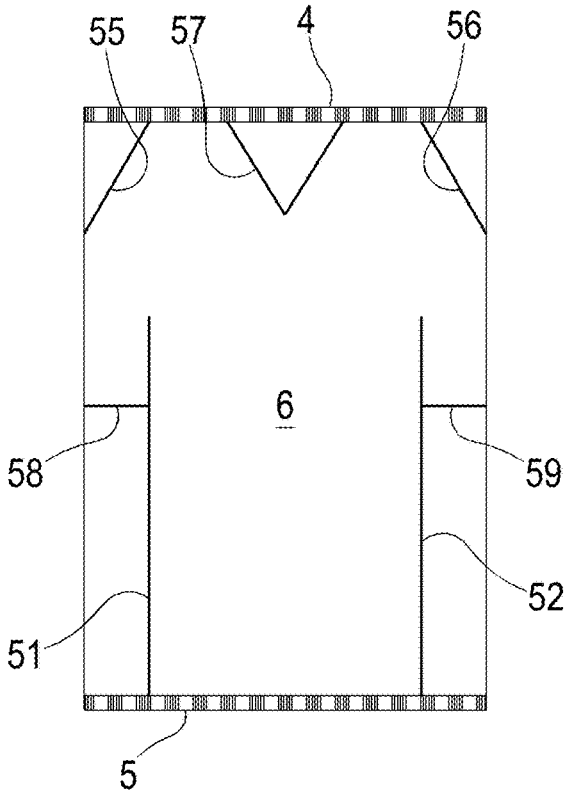
FIGS. 7 and 8 show in a schematic manner a front view and a rear view, respectively, of a tubular textile article in accordance with a further example of implementation of the process according to the present invention, in order to obtain a garment according to a further possible embodiment.
Figure 8:
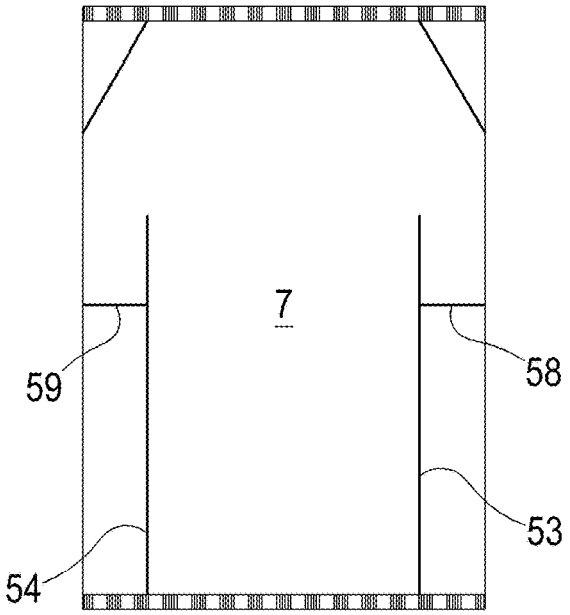

FIGS. 7 and 8 show in a schematic manner a further variant of embodiment of the tubular textile article 3 in accordance with the present invention.

In this case the processes and technical features already described above still apply, though with the addition of some new elements.

First of all, the plurality of cutting line comprises a seventh cutting line 57, which begins from the upper edge 4 of the front side 6 of the tubular textile article, descends towards the lower edge 5 as far as to a specific lower height and ascends until terminating again on the upper edge 4 of the rear side 6. The seventh cutting line 57 has a shape defined based on the result to be obtained for the neck, and is preferably symmetrical with the center of the front trunk portion.

Following the step of cutting the tubular textile article along the seventh cutting line 57, a neck piece extended between the upper edge 4 of the tubular textile article and the seventh cutting line 57 is removed. Thus the desired shape for the neck (e.g. a "V"-shaped neck) is obtained.

The plurality of cutting lines can further include an eighth cutting line 58 and a ninth cutting line 59. arranged transversally to the development of the tubular textile article (i.e. substantially perpendicular to the central axis X) and comprised between the first 51 and third 53 cutting line and between the second 52 and the fourth 54 cutting line, respectively.

As shown in the views (front and rear part of the tubular textile article) of FIGS. 7 and 8, the eighth cutting line 58 is located on the right sleeve portion 31 and the ninth cutting line 59 is located on the left sleeve portion 41. The eighth cutting line 58 and the ninth cutting line 59 develop between two respective ends that terminate (i.e. end) on the first 51 and on the third 53 cutting line and on the second 52 and on the fourth 54 cutting line, respectively.

The cuts made along the eighth cutting line 58 and along the ninth cutting line 59 cause the detachment or removal of the sleeve portions comprised between the cutting line and the lower end of the sleeve portion.

Thus a short-sleeved garment 1 can be obtained.

The garment 1 obtained from the tubular textile article of FIGS. 7 and 8 (by way of example with V neck and short sleeves) is shown in FIG. 9.

It should be noted that the elements shown in FIGS. 7, 8 and 9, i.e. shaped neck and short sleeves, are independent from one another and are not necessarily included together in the same garment.

In general, the various structures (shape of cutting line and of junction lines, inserts, variously shaped neck or sleeves, etc.) are independent from one another and can be variously combined in different embodiments of garments according to the present invention.

The present invention encompasses also alternative embodiments of garments, differing from the exemplary embodiments shown in the figures, having in common the fact of being made from one single tubular textile article and by the operations described above.

The invention achieves important advantages. First of all, the invention allows to overcome at least some of the drawbacks of prior art.

The process forming the object of the present invention allows to make a complete garment, provided with a trunk and two sleeves, using one single tubular textile article.

The process of the present invention further allows to reduce the complexity of operations with respect to known solutions.

In addition, the process of the present invention allows to highly reduce cost and time required for making a complete garment, with respect to known solutions.

For instance, the invention, since it makes it possible to obtain a garment directly from one single tubular article suitably processed, allows to reduce complexity and costs typically related to the manufacturing steps of a garment in the prior art (cutting, moving, piece handling, etc.).

The process of the present invention allows to reduce the intervention of operators and can be advantageously automated and implemented by means of an automated production line.

Moreover, the process of the present invention further allows to make a garment reducing processing scraps.

The process of the present invention further allows to reduce errors during production and manufacturing.

The process of the present invention allows to obtain series of garments with high quality and uniform features.

The garments according to the present invention are characterized by a better wearability and better comfort for the user.

The present invention can be particularly implemented for making garments such as underwear and sports shirts, which typically require high features as far as comfort of use is concerned.

The invention allows in general to make a garment with specific features, imparting to it given technical and aesthetic properties.

The invention claimed is:

1. Process for making a garment (1), said garment being a knitted fabric provided at least with a trunk (T), with a right sleeve (MD) and with a left sleeve (MS), the process comprising the steps of:

arranging a circular textile machine;

producing a tubular textile article (3) by means of said circular textile machine, having a shape substantially with cylindrical surface extended continuously around a central axis (X) of the article between an upper edge (4) and a lower edge (5), and wherein on said tubular textile article (3) a front side (6) and a rear side (7) are definable, divided from each other with respect to a median plane (A);

defining or identifying, on said tubular textile article (3), a plurality of cutting lines (51, 52, 53, 54);

cutting the tubular textile article (3) along said plurality of cutting lines in order to define and separate a plurality of fabric portions (11, 21, 31, 41) of the tubular textile article (3) from each other, each fabric portion belonging to said front side (6), or to said rear side (7), or partially to the front side and partially to the rear side; wherein said fabric portions are separated from each other, by means of the cutting lines, but said fabric portions remain at least partially connected in the tubular textile article (3);

joining said fabric portions of the tubular textile article (3) in order to obtain the trunk (T) of the garment, the right sleeve (MD) and the left sleeve (MS);

wherein, following said joining step, the garment (1) obtained from the tubular textile article (3) has zones of passage between the trunk (T) and the right (MD) and left (MS) sleeves lacking stitching or discontinuities in the fabric, and the passage from the fabric of the trunk (T) to the fabric of the right (MD) and left (MS) sleeves occurs at least partially without interruption.

2. The process according to claim 1, wherein the aforesaid passage zones between the trunk (T) and the right (MD) and left (MS) sleeves are zones of the garment adapted to be placed, both on the front side (6) and on the rear side (7), between the shoulders and the axillae, or wherein the garment (1) does not have stitching, discontinuities or junctions—neither at the right armhole, nor at the left armhole, or wherein said median plane (A) vertically divides the tubular textile article (3) substantially into two halves, corresponding to said front side (6) and said rear side (7).

3. The process according to claim 1, wherein said fabric portions comprise at least:

a front trunk portion (11), belonging to the front side (6) of the tubular textile article (3);

a rear trunk portion (21), belonging to the rear side (7) of the tubular textile article (3);

a right sleeve portion (31), comprising fabric both of the front side (6) and of the rear side (7), and intersecting said median plane (A); and a left sleeve portion (41), comprising fabric both of the front side (6) and of the rear side (7), and intersecting said median plane (A) on the opposite side of said central axis (X) with respect to the right sleeve portion (31);

and wherein said step of joining said fabric portions comprises:

joining said front trunk portion (11) to said rear trunk portion (21) in order to make the trunk (T) of the garment, said trunk having at least a partially tubular shape;

closing said right sleeve portion (31) for making the right sleeve (MD), said right sleeve having at least a partially tubular shape;

closing said left sleeve portion (41) for making the left sleeve (MS), said left sleeve having at least a partially tubular shape, and wherein said step of cutting the tubular textile article (3) attains, by following a circumferential extension of the tubular textile article around the central axis (X), an alternation between a trunk portion (11; 21) and a sleeve portion (31; 41).

4. The process according to claim 1, wherein, in said step of producing the tubular textile article (3), a single tubular textile article (3) is produced which allows entirely making the trunk (T) and the sleeves (MD, MS) of the garment (1), or wherein the trunk (T), the right sleeve (MD) and the left sleeve (MS) are overall at least partially joined and continuous with respect to each other in a single-piece fabric, and the trunk (T), the right sleeve (MD) and the left sleeve (MS) are never detached or separated from each other, or wherein said fabric portions (11, 21, 31, 41), following said step of cutting the tubular textile article (3), are not completely divided or uncoupled from each other, but rather said fabric portions (11, 21, 31, 41) remain at least partially joined in the single-piece tubular textile article.

5. The process according to claim 1, wherein said step of defining or identifying, on said tubular textile article (3), the plurality of cutting lines comprises one or more of the following operations:

designing on the tubular textile article (3), in construction step, said cutting lines (51, 52, 53, 54), by means of threads of a different color with respect to the adjacent portions of the tubular textile article;

showing or projecting on the tubular textile article (3), before and/or during said step of cutting the tubular textile article, said cutting lines (51, 52, 53, 54), by means of an optical light or laser device capable of defining and rendering the cutting lines visible;

programming a machine for automated cutting, defining inside the machine for automated cutting, in a control software for such machine, the cutting lines (51, 52, 53, 54) such that the machine for automated cutting can operate on the tubular textile article (3) and automatically make said cutting lines;

tracing on the tubular textile article, before and/or during said step of cutting the tubular textile article, said cutting lines (51, 52, 53, 54).

6. The process according to claim 1, wherein each of said cutting lines creates two fabric margins belonging to two adjacent fabric portions, the two margins being at the sides of the cutting line, and wherein said plurality of cutting lines comprises at least one first cutting line (51), one second cutting line (52), one third cutting line (53) and one fourth cutting line (54), wherein:

the first cutting line (51) is positioned on the front side (6) of the tubular textile article (3) and separates the front trunk portion (11) and the right sleeve portion (31) from each other, thus attaining a right margin (12) of the front trunk portion (11) and a front margin (32) of the right sleeve portion (31);

the second cutting line (52) is positioned on the front side (6) of the tubular textile article (3) and separates the front trunk portion (11) and the left sleeve portion (41) from each other, thus attaining a left margin (13) of the front trunk portion (11) and a front margin (42) of the left sleeve portion (41);

the third cutting line (53) is positioned on the rear side (7) of the tubular textile article (3) and separates the rear trunk portion (21) and the right sleeve portion (31) from each other, thus attaining a right margin (22) of the rear trunk portion (21) and a rear margin (33) of the right sleeve portion (31);

the fourth cutting line (54) is positioned on the rear side (7) of the tubular textile article (3) and separates the rear trunk portion (21) and the left sleeve portion (41) from each other, thus attaining a left margin (23) of the rear trunk portion (21) and a rear margin (43) of the left sleeve portion (41).

7. The process according to claim 6, wherein, following the step of cutting the tubular textile article along said first (51), second (52), third (53) and fourth cutting lines (54):

the front trunk portion (11) is laterally extended between the right margin (12) and the left margin (13) of the front trunk portion (11) and is entirely on the front side (6);

the rear trunk portion (21) is laterally extended between the respective right margin (22) and the respective left margin (23) of the rear trunk portion (21) and is entirely on the rear side (7);

the right sleeve portion (31) is laterally extended between the front margin (32) and the rear margin (33) of the right sleeve portion (31) and is thus shared between the front side (6) and the rear side (7);

the left sleeve portion (41) is laterally extended between a respective front margin (42) and a respective rear margin (43) of the left sleeve portion (41) and is thus shared between the front side (6) and the rear side (7);

or wherein, in said step of joining said fabric portions of the tubular textile article:

the right margin (12) of the front trunk portion (11) is joined with the respective right margin (22) of the rear trunk portion (21), by means of a first junction line (61);

the left margin (13) of the front trunk portion (11) is joined with the respective left margin (23) of the rear trunk portion (21), by means of a second junction line (62);

in such a manner, the first (61) and the second (62) junction line complete the connection of the front trunk portion (11) with the rear trunk portion (21), thus making the trunk (T) of the garment;

the front margin (32) of the right sleeve portion (31) is joined with the rear margin (33) of the same right sleeve portion (31), by means of a third junction line (63);

the front margin (42) of the left sleeve portion (41) is joined with the rear margin (43) of the same left sleeve portion (41), by means of a fourth junction line (64);

in such a manner the third junction line (63) closes and completes the right sleeve (MD) of the garment, and the fourth junction line (64) closes and completes the left sleeve (MS) of the garment, or wherein said first junction line (61), second junction line (62), third junction line (63) and fourth junction line (64) are stitching lines made between the two involved fabric margins, or said first junction line (61), second junction line (62), third junction line (63) and fourth junction line (64) are attained with taping, gluing or welding.

8. The process according to claim 7, comprising the steps of:

applying a right insert to the tubular textile article (3), in a position comprised between said first junction line (61) and said third junction line (63), in a manner such that the right insert is interposed between, and connecting, said first junction line and said third junction line, said right insert being intended to be, with garment in use, at the right axilla of the user;

applying a left insert to the tubular textile article (3), in a position comprised between said second junction line (62) and said fourth junction line (64), in a manner such that the left insert is interposed between, and connecting, said second junction line and said fourth junction line, said left insert being intended to be, with garment in use, at the left axilla of the user.

9. The process according to claim 8, wherein said right insert and said left insert are configured for:

eliminating discontinuities respectively present between the first and the third junction lines and between the second and the fourth junction lines; or for preventing the presence of junction lines in the two zones of the garment intended to be, with the garment in use, at the axillae of the user; or for suitably shaping the garment in the two zones of the garment intended to be, with garment in use, at the axillae of the user;

or wherein said right insert and said left insert are made of breathable fabric and/or of reinforcing fabric.

10. The process according to claim 7, comprising the step of applying one or more inserts to the tubular textile article (3) in specific positions along one or more junction lines, and wherein each of said one or more inserts is intended to be interposed along a specific junction line, locally interrupting, at the position where the respective insert is situated, the continuity of the respective junction line, or wherein a first insert can be inserted along the first junction line (61), so as to provide the garment with a right side insert, or wherein a second insert can be inserted along the third junction line (63), so as to provide the garment with a left side insert, or wherein said respective insert is configured for suitably shaping the garment (1) in the zone of the garment where said respective insert is positioned, or for providing the zone with particular characteristics of elasticity or compression or breathability and/or specific aesthetic or technical characteristics.

11. The process according to claim 7, wherein said plurality of cutting lines comprises a fifth cutting line (55) and a sixth cutting line (56), wherein:

the fifth cutting line (55) starts from the upper edge (4) of the front side (6) of the tubular textile article (3), descends towards said lower edge (5) to a specific height (75) and re-ascends up to terminating on the upper edge (4) of the rear side (7) of the tubular textile article (3), said fifth cutting line (55) being at least partially vertically superimposed on the right sleeve portion (31);

the sixth cutting line (56) starts from the upper edge (4) of the front side (6) of the tubular textile article (3), descends towards said lower edge (5) to a specific height (76) and re-ascends up to terminating on the upper edge (4) of the rear side (7) of the tubular textile article (3), said sixth cutting line (56) being at least partially vertically superimposed on the left sleeve portion (41);

wherein the fifth cutting line (55) and the sixth cutting line (56) are defined on opposite sides of the tubular textile article (3) with respect to the central axis (X), and wherein, following the step of cutting the tubular textile article along said fifth (55) and sixth (56) cutting lines:

a front right shoulder margin is obtained on said front side (6), and a rear right shoulder margin is obtained on said rear side (7);

a front left shoulder margin is obtained on said front side (6), and a rear left shoulder margin is obtained on said rear side (7), and wherein, in said step of joining said fabric portions of the tubular textile article:

the front right shoulder margin is joined with the rear right shoulder margin, by means of a fifth junction line (65) which makes a right shoulder of the garment;

the front left shoulder margin is joined with the rear left shoulder margin, by means of a sixth junction line (66) which makes a left shoulder of the garment;

wherein the fifth and the sixth junction lines complete the connection of the upper parts of the front trunk portion (11) and the upper parts of the rear trunk portion (21), thus attaining the left and right shoulders at the top of the trunk (T) of the garment, and wherein between the fifth junction line (65) and the sixth junction line (66), the opening is present for a neck of the user.

12. The process according to claim 1, comprising a step of suitably sizing the trunk (T) and the right (MD) and left (MS) sleeves in a manner such that the right and left sleeves are longer than the trunk of the garment, and wherein the respective lower ends of the right sleeve (MD) and of the left sleeve (MS) have a length-wise extension that terminates with garment (1) completed lower than the lower end of the trunk (T), or wherein said sizing step is executed in said step of producing a tubular textile article, in a manner such that the parts of the tubular textile article intended, following the cuts, to form the right sleeve portion (31) and the left sleeve portion (41) are longer than the parts of the tubular textile article intended, following the cuts, to form the front trunk portion (11) and the rear trunk portion (21), or wherein said sizing step comprises a step of removing a lower section (15) of the front trunk portion (11) and a respective lower section (25) of the rear trunk portion (21), in a manner such to shorten the front and rear trunk portions with respect to the right sleeve (31) and left sleeve (41) portions, obtaining a trunk (T) that is shorter than the sleeves.

13. The process according to claim 1, comprising a step of making a double hem (81) at the lower edge of the trunk (T) of the garment (1), or wherein the process comprises a step of making respective double hems (82, 83) at the respective lower ends of each of the two right (MD) and left (MS) sleeves, or wherein said step of making a double hem is attained simultaneously with the step of producing the tubular textile article, by means of the attainment of a double fabric or a cuff at the lower edge (5) of the tubular textile article, in such a manner the tubular textile article (3) already being produced with the entire lower edge (5) of the trunk made of double fabric for the entire circumferential extension of the trunk and, following the steps of cutting the tubular textile article and joining the fabric portions obtained, the trunk (T) and/or the right sleeve (MD) and the left sleeve (MS) result already provided with a respective double hem (81; 82; 83) at the lower end of the trunk and/or the sleeves.

14. The process according to claim 1, wherein, both on the front side and on the rear side of the garment (1), there is a direct passage of the fabric from the trunk (T) to the sleeves (MD, MS), without the presence of a right armhole or a left armhole.

15. The process according to claim 1, wherein there is never, from the step of producing the tubular textile article (3) to the end of the production or packaging of the garment (1), a step of longitudinally cutting the tubular textile article from the lower edge (5) to the upper edge (3) or vice versa, nor a step of opening the tubular textile article (3), rendering the tubular textile article a flat piece of fabric, or wherein, in said step of cutting the tubular textile article (3), said cutting lines do not cause an opening of the tubular textile article and the tubular textile article (3) maintains at least one tubular fabric portion continuous and closed all around the central axis (X).

16. The process according to claim 1, wherein said cutting lines (51, 52, 53, 54) all start from said lower edge (5) of the tubular textile article (3) and are extended towards said upper edge (4), or wherein said cutting lines extended from said lower edge (5) terminate in the tubular textile article before reaching the upper edge (4), said cutting lines not terminating on or leading to the upper edge.

17. The process according to claim 1, wherein one or more of the cutting lines (51, 52, 53, 54) are variously shaped or undulated in order to obtain a specific three-dimensional shape of the trunk (T) and/or of the sleeves (MD, MS) in the finished garment.

18. The process according to claim 1, wherein said step of joining said fabric portions occurs by means of attainment of stitching between the fabric portions to be joined.

* * * * *